United States Patent [19]

Moody

[11] 4,416,614

[45] Nov. 22, 1983

[54] ASPHALT HEATING KETTLE APPARATUS

[75] Inventor: Albert L. Moody, Lawrenceville, Ga.

[73] Assignee: F. C. Brown Rentals, Inc., Smyrna, Ga.

[21] Appl. No.: 418,615

[22] Filed: Sep. 16, 1982

Related U.S. Application Data

[62] Division of Ser. No. 214,631, Dec. 10, 1980.

[51] Int. Cl.[3] ..... F23Q 9/00; E01C 19/45

[52] U.S. Cl. ..... 431/278; 126/343.5 R; 126/343.5 A; 431/263

[58] Field of Search ..... 431/278, 191, 192, 127, 431/193, 194, 284, 285; 126/343.5 A, 343.5 R

[56] References Cited

U.S. PATENT DOCUMENTS

| | | | |
|---|---|---|---|
| 2,504,592 | 4/1950 | Scharbau et al. | 431/278 |
| 2,603,283 | 7/1952 | Swenson et al. | 431/278 |
| 3,171,405 | 3/1965 | Miller | 126/343.5 R |
| 3,404,939 | 10/1968 | Saha | 431/263 |
| 3,692,016 | 9/1972 | Stikkers et al. | 431/278 X |
| 4,141,213 | 2/1979 | Ross . | |

*Primary Examiner*—Larry Jones

*Attorney, Agent, or Firm*—Jones & Askew

[57] ABSTRACT

Asphalt heating kettle with improved temperature control to prevent overheating, and with improved gas fuel pilot light to prevent pilot blowout. The temperature sensor for the kettle is housed in an apertured tube in direct heat transfer contact with a burner flue within the kettle, so that the temperature both of liquid asphalt and of the flue itself is sensed to prevent an overheat condition. The pilot burner is located behind the main burner, upstream of the high-velocity flame from the main burner, so as to be unaffected by the blast or shock wave of main burner ignition.

5 Claims, 5 Drawing Figures

ASPHALT HEATING KETTLE APPARATUS

This application is a division, of application Ser. No. 214,631, filed Dec. 10, 1980.

BACKGROUND OF THE INVENTION

This invention relates in general to kettles for heating asphalt, and relates in particular to improvements in temperature control and gas fuel burner pilot flame apparatus used with such kettles.

Asphalt heating kettles are known, and are typically used in various applications where a limited supply of hot liquid asphalt is required. The construction and repair of built-up roofs is one such application. The asphalt kettles in simplest form include a tank or "kettle" for receiving and holding a quantity of asphaltic material, and a suitable heater such as a propane gas burner for heating the kettle. The kettles are usually equipped with wheels, and are easily towed to the job site.

Asphalt is a solid material at normal room temperature, and must be heated in order to become sufficiently liquified for practical application. Portable asphalt kettles are typically provided with a gas fuel burner fired from a self-contained supply of gas such as propane or the like. The gas flame from the burner passes through one or more flues extending through the asphalt-receiving kettle. The heat of these flues liquifies the solid asphalt introduced into the kettle, and then maintains the liquified asphalt at an elevated temperature sufficient for the intended application.

Certain problems associated with burner control have arisen in the practical use of prior-art asphalt kettles, because the asphalt must be maintained within a range of temperatures generally not exceeding approximately 450° F. If the asphalt temperature falls below the desired range, the asphalt thickens and lacks sufficient fluidity for easy application. If the maximum temperature within the kettle is improperly controlled, the kettle temperature will exceed the flash-point temperature of asphalt, causing the asphalt to ignite within the kettle. The resulting asphalt fire can damage the kettle unless promptly extinguished, and may injure inexperienced persons attempting to put out the fire.

The problem of maintaining proper temperature control in asphalt kettles is made more difficult by the fact that kettle user-operators are typically inexperienced, and often fail to appreciate the hazard of overheating an asphalt kettle. The kettle gas burner is typically operated at a particular setting when the kettle is initially filled, and allowed to operate at the same setting as asphalt is withdrawn from the kettle. The burner continues to supply the same amount of heat to the kettle while the heat-absorbing asphalt is removed, frequently allowing the kettle temperature to reach the flash point as the kettle becomes empty.

Prior art attempts for thermostatic control of asphalt kettle burners have been less than satisfactory. As noted above, the amount of heat required by the kettle varies with the amount of asphalt in the kettle. Furthermore, merely placing a temperature sensor such as a thermostat bulb in the kettle will be relatively ineffective during cold start-up, where the kettle contains solid asphalt at ambient temperature. Asphalt in contact with the heated flue will rapidly melt and may become overheated, even though the layer mass of asphalt in the kettle remains unliquified.

Past attempts to provide thermostatic control for gas fuel burners in asphalt kettles has produced the related problem of pilot flame blowout. The conventional gas burner includes a main burner typically providing a relatively high velocity flame aimed in a generally horizontal direction to enter the flue extending through the asphalt kettle, and also includes a pilot burner directing a pilot flame into a region directly in front of the main burner. The pilot flame is ignited at the start of kettle operation, and this flame burns continuously as the main burner turns on and off in response to thermostatic control.

When the gas supply to the main burner is turned on in response to the thermostat, the volume of gas flowing through the high-velocity main burner is ignited by the pilot flame. This ignition frequently causes a sudden blast or shock wave caused by the sudden ignition of gas from the burner. The effect of this blast is intensified because the burner assembly is housed in an enclosure of relatively small volume, and the blast frequently blows out the pilot flame. Although safety devices are typically provided to shut off the gas supply in the absence of a sensed pilot flame, the asphalt kettle and its contents are no longer heated. The absence of burner operation will typically be discovered only some time later, after the kettle has cooled and the asphalt therein has commenced to hardened. The burner must now be relit, while the work crew remains idle waiting for the asphalt to be reheated to a usable temperature.

SUMMARY OF INVENTION

Accordingly, it is an object of the present invention to provide an improved asphalt heating kettle.

It is another object of the present invention to provide an asphalt heating kettle with improved temperature control capability.

It is yet another object of the present invention to provide an asphalt heating kettle for maintaining asphalt at a selected temperature.

It is still another object of the present invention to provide an asphalt heating kettle with improved temperature control to eliminate or reduce the risk of overheating the asphalt to the flash-point temperature.

It is a further object of the present invention to provide an improved pilot light arrangement for a high-velocity gas fuel burner.

Stated in somewhat general terms, improved temperature control according to the present invention is obtained by controlling burner operation in response both to the temperature of liquified asphalt within the kettle, and to the temperature of the heated flue in the kettle. This result is obtained by placing a temperature sensing element within the kettle for exposure to the asphalt therein, and also for heat-transfer exposure to the flue.

Stated somewhat more specifically, the temperature sensing element is disposed within a receptacle which is mounted in direct heat-transfer contact with a flue within the kettle. The receptacle is positioned within the kettle to be immersed within the liquid asphalt therein, and is apertured so that the liquid asphalt can enter the receptacle for direct contact with a temperature sensing element therein. This arrangement enables the temperature sensing element to respond to the temperature of the liquid asphalt surrounding the receptacle, and to respond to the temperature of the heated flue in the absence of liquid asphalt at that level.

The improved pilot light arrangement of the present invention includes a main burner operative to direct gas fuel at a substantial velocity along a predetermined path, and a pilot burner positioned behind the main burner. The flame from the pilot burner originates at a point upstream from the main burner flame, so that the pilot flame is relatively unaffected by the blast or shock wave caused when the main burner ignites.

The foregoing and other objects and advantages of the present invention will become more readily apparent from the following description of the preferred embodiment.

DESCRIPTION OF PREFERRED EMBODIMENT

Figure 1:
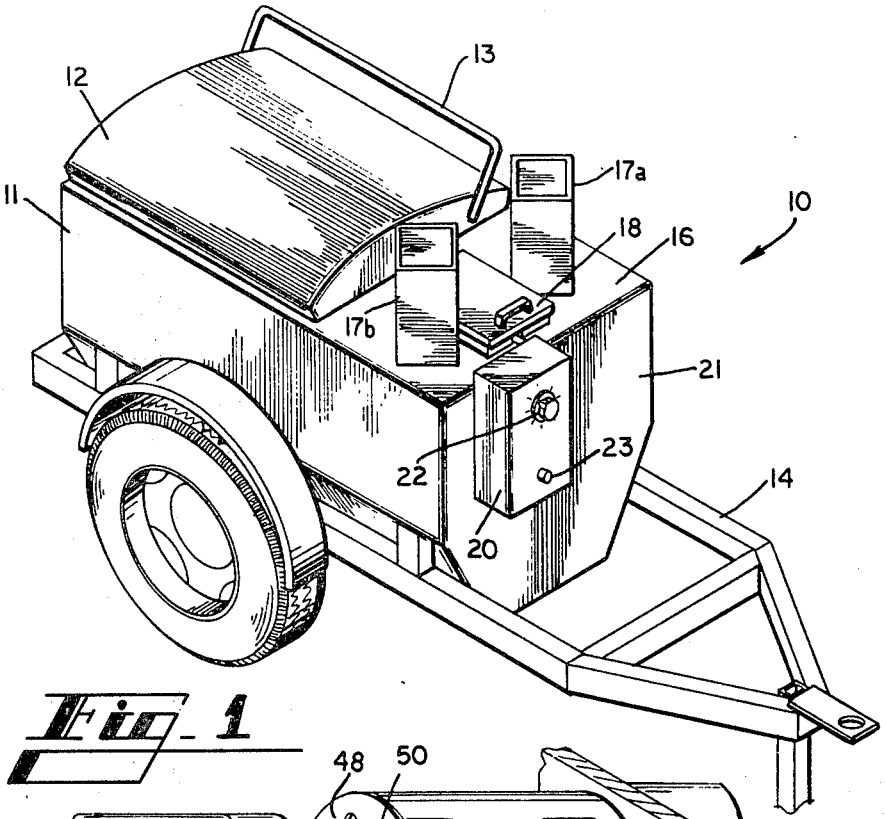
FIG. 1 shows a pictorial view of an asphalt heating kettle according to a disclosed embodiment of the present apparatus.

Turning first to FIG. 1, there is shown generally at 10 an embodiment of asphalt heating kettle according to the present invention. The kettle 10 includes an outer housing 11 having a top open at the back end, and covered by a lid 12. A handle 13 is attached to the lid 12, and those skilled in the art will recognize that the lid 12 is opened for placing solid asphalt into the kettle to be melted. The entire outer housing 11 is supported on a frame 13 equipped with wheels and a suitable hitch connection for towing.

Figures 4, 5:
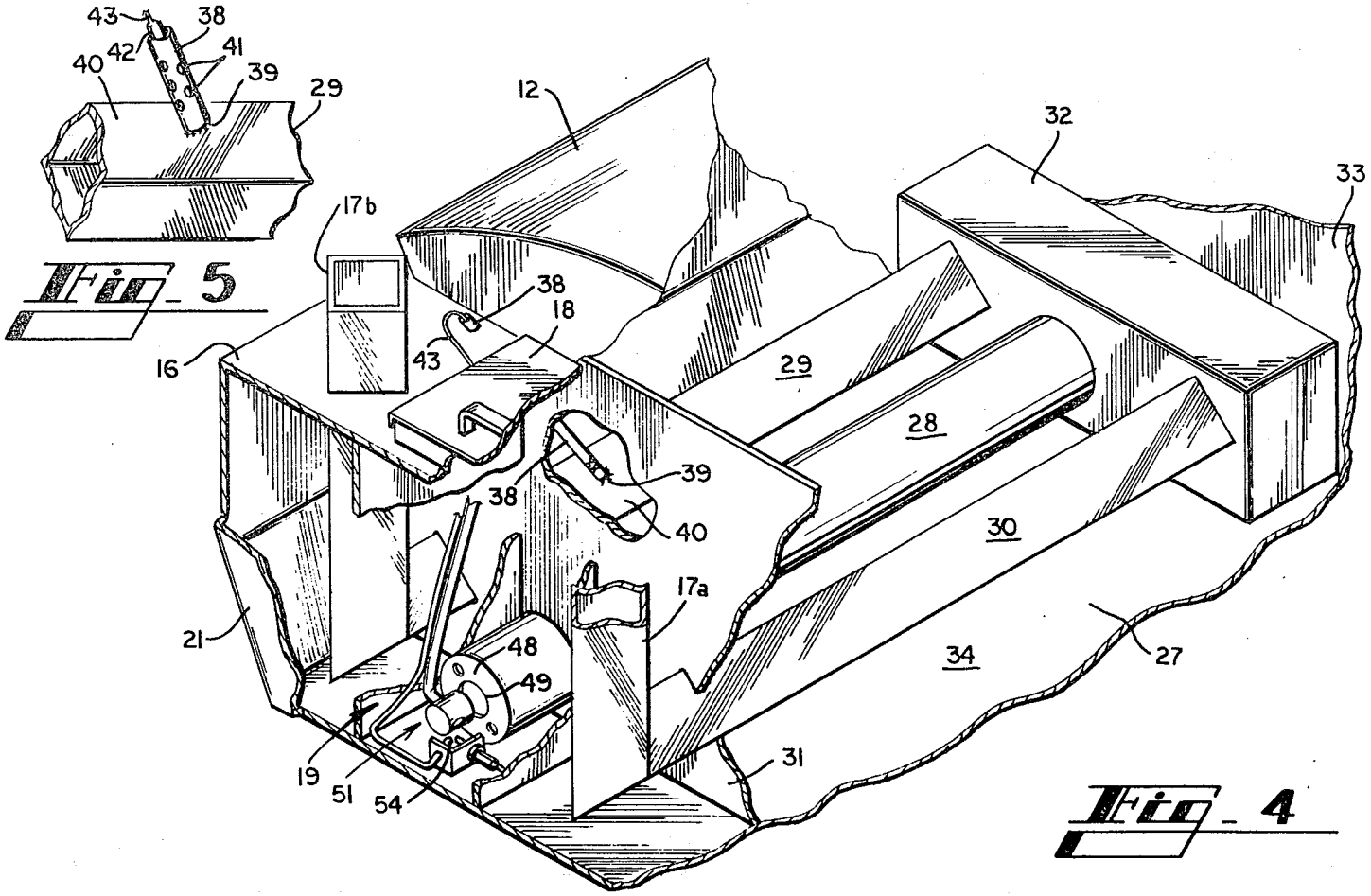
FIG. 4 is a fragmentary pictorial view, partially broken away, showing internal details of the disclosed kettle.
FIG. 5 is an enlarged fragmentary pictorial view showing the receptacle for the temperature responsive element in the disclosed embodiment.

The top portion of the outer housing 11 in front of the lid 12 includes a panel 16 from which protrude a pair of vertical flues 17*a* and 17*b*. A cover 18 is placed on the panel 16 between the two vertical flues, and as best seen in FIG. 4 the cover 18 encloses a compartment 19 in which the gas fuel burner assembly is located. A control box 20 is mounted on the front wall 21 of the kettle outer housing 11, and the control box includes a temperature setting control 22 and a pilot igniter control 23. A cylinder containing fuel such as propane is normally mounted on the frame 14 in front of the kettle, but is omitted from the present drawings for clarity.

Turning next to FIG. 4, the interior 27 of the kettle comprises an open asphalt-receiving region having a burner flue 28 and a pair of exhaust flues 29 and 30 extending longitudinally the length of the interior. The burner flue 28 extends through the front wall 31 of the interior 27, and projects a distance into the burner compartment 19. The rear end of the burner flue 28 terminates in communication with the hollow cross-box 32 contained within the interior 27, adjacent the back wall 33 thereof.

Each of the exhaust flues 29 and 30 are also in fluid communication with the cross-box 32, and extend forwardly to terminate a short distance in front of the front wall 21 of the kettle outer housing 11. The exhaust flues there join the lower ends of the vertical flues 17*a* and 17*b*, which extend upwardly through the panel 16 of the kettle outer housing. Each of the exhaust flues 29 and 30 has a cross-section configuration substantially in the shape of a diamond, as seen in relation to the horizontal floor 34 of the kettle interior 27.

A hollow tube 38 extends downwardly through the top panel 16 of the kettle outer housing 11, and the lower end 39 of the tube contacts one of the upwardly-facing walls 40 of the exhaust flue 29. The lower end 39 of the tube 38 is secured to the flue wall 40 by welding or the like, to insure a good heat-transfer relationship between the flue wall and the tube. As best seen in FIG. 5, a number of holes 41 are formed in the tube 38 commencing approximately one-half inch above the tube lower end 39, for a purpose described below.

Received within the tube 38 is a temperature sensing element 42 (FIG. 5), which may be a conventional device such as a mercury-bulb element or the like. A control line 43 is attached to the sensing element 42 and extends within the tube 38 to exit its upper end as shown in FIG. 4. The control line 43 extends to the main burner gas control valve 44 (FIG. 3) and controls the flow of gas to the main burner in a conventional manner.

The forward end of the burner flue 28 is covered by a plate 48 having a central opening 49 to receive the flame from the outlet 50 of the high-velocity burner 51. The main burner functions to direct a high velocity flame on a substantially horizontal path aimed into the burner flue 28 through the opening 49, and the flame flows along the burner flue toward the cross-box 32. The flame or its hot combustion gases leave the cross-box and flow forwardly through the two exhaust flues 29 and 30, and then enter the vertical flues 17*a* and 17*b* to be exhausted to atmosphere. The heated surfaces of the burner flue 28, the cross-box 32, and the two exhaust flues 29 and 30 melt solid asphalt placed in the interior 27 of the kettle, and maintain the asphalt in a liquid state.

Figure 2:
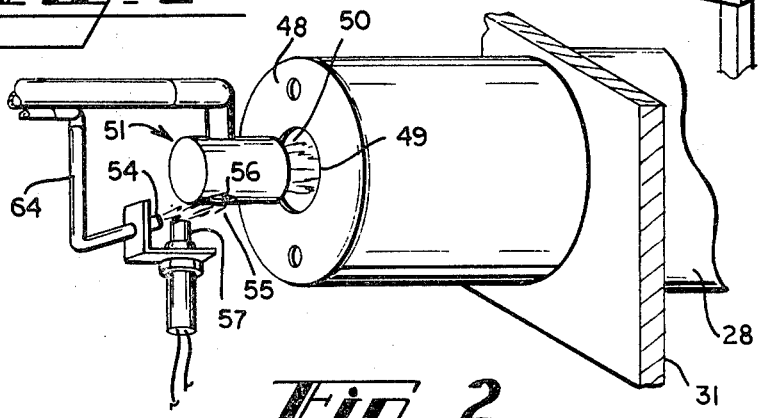
FIG. 2 is a fragmentary pictorial view showing the main burner and pilot burner in the disclosed embodiment.

Situated a distance in front of the main burner 51, well upstream of the burner origin of the flame entering the burner flue 28 from the main burner, is the pilot burner 54. The outlet of the pilot burner 54 is positioned to direct the pilot flame 55 (FIG. 2) in a direction substantially aligned with the flow direction of the main burner flame, and with sufficient velocity to reach the pilot ignition opening 56 in the side of the main burner 51. An electrical igniter 57 is disposed in front of the pilot burner 54, and is connected to the pilot igniter control 23 on the control box 20 to produce an ignition spark required to initially ignite the pilot flame. Such electrical igniters are known to those skilled in the art.

Figure 3:
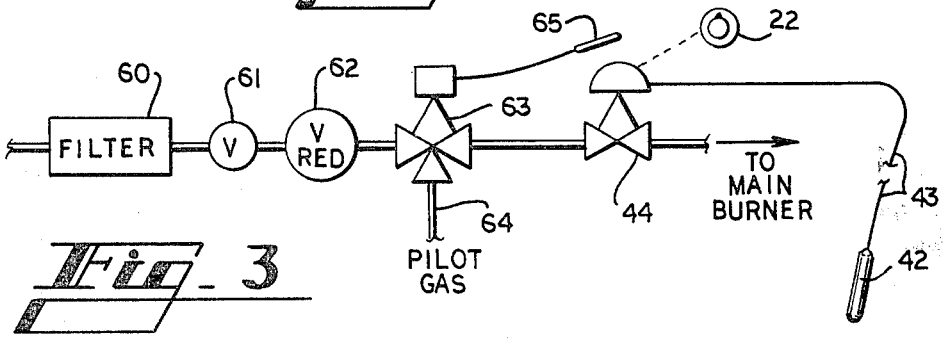
FIG. 3 is a schematic view showing the gas flow and control arrangement in the disclosed embodiment.

The gas fuel system for the main burner and pilot burner of the present kettle apparatus is shown in FIG. 3. This apparatus includes a filter 60, a main valve 61, and a pressure reducing valve 62 connected in series to supply gas to the pilot burner valve 63. The pilot burner valve supplies gas along line 64 to the pilot burner 54. Also associated with the pilot burner valve 63 is a thermocouple 65, not shown in FIG. 2 but positioned in a manner known to those skilled in the art to sense the pilot flame 55. In the absence of a pilot flame sensed by the thermocouple 65, the valve 63 shuts off all gas flow to the pilot burner 64 and to the main burner control valve 44. The temperature setting control 22 is also operatively coupled to the main burner control valve, and operates in conjunction with the sensed temperature signal supplied from the temperature sensing element 42 to control the main burner as required to maintain asphalt in the interior compartment 27 at a temperature preset by the control 22.

The operation of the kettle 10 is now described. Assuming a quantity of solid asphalt is in the interior 27, the pilot burner is lit by turning on the main valve 61 and then operating the pilot igniter 57. Ignition of the pilot flame is sensed by the thermocouple 65, causing the main gas valve 44 to turn on in the conventional manner. Gas is now supplied to the main burner 51, and the pilot flame 55 directed to the opening 56 in the main burner ignites the main burner flame. The substantial blast or shock wave of main burner ignition is generally present in the region surrounding the main burner outlet 50, and that blast has substantially no effect on the pilot flame 55 located substantially behind the main burner 51. The pilot burner may be provided with a sprial swirl-producing element to impart a swirling pattern to the pilot flame, thereby rendering the pilot flame even less susceptible to blow-out.

The main burner flame flowing through the burner flue 28 and the exhaust flues 29 and 30 heat those flues, and the heat of the flues commences heating the asphalt to a liquid state. As the asphalt liquifies surrounding the lower end of the tube 38, liquid asphalt enters the tube through the holes 41 and becomes in direct heat transfer contact with the temperature sensing element 42 within the tube. The sensing element 42 thus controls the main burner valve 44 in response to the temperature of liquid asphalt in the kettle, and operates to throttle the main burner flame when the liquid asphalt temperature surrounding the sensing element reaches the selected temperature of the setting control 22. The main burner control 44 now operates in a manner known to those skilled in the art to increase or decrease the flow of gas to the main burner, as necessary to maintain the preset temperature in response to the actual asphalt temperature measured by the sensing element 42.

During cold startup of the kettle, the main burner 40 typically operates at full throttle and may supply heat to the kettle at a rate faster than can be transferred through the flues 28–30 to a mass of cool asphalt within the kettle. Consequently, the temperature of the flues can exceed the flash point temperature of asphalt, creating the risk of a fire within the kettle. With the present invention, the temperature of the flue itself is sensed by the sensing element 42 within the tube 38, because the tube is in direct heat-transfer contact with a flue surface 40. This incipient overheat condition is thus promptly detected in time to throttle back the main burner, thereby supplying heat at a reduced rate which prevents flue temperatures from exceeding the preset temperature. The main burner may be throttled up to reach its full capacity in response to the temperature sensing element 42, as more asphalt in the kettle liquifies and conducts heat away from the flues.

Another incipient overtemperature condition exists when sufficient asphalt is removed from the interior 27 to uncover at least the upper portions of the flues 28–30. The absence of heat-absorbing liquid asphalt entirely surrounding these flues allows the flue temperature to increase, and this increased temperature is directly sensed by the sensing element 42 within the tube 38. The main burner is thus throttled back as described above, thereby preventing an overheat condition while maintaining sufficient heat input to keep the asphalt at a desired temperature.

If the kettle is shut off with substantial asphalt remaining in the kettle, the asphalt surrounding the temperature sensing element 42 within the tube solidifies as the asphalt cools. If it becomes necessary to remove the sensing element 42 from the tube 38 for servicing or replacement, the main burner must be operated sufficiently to liquify the asphalt within the tube 38. The sensing element 42 is then easily withdrawn through the upper end of the tube 38, and a replacement sensing element can then be inserted for immersion in the liquid asphalt at the lower end of the tube.

It is thus seen that the present kettle maintains a desired preset temperature of asphalt by operating the main burner in response to the temperature of the heated flue as well as the asphalt within the kettle. When the kettle contains a substantial quantity of liquid asphalt, the temperature sensing element 42 is in direct contact with the liquid asphalt through the holes 41 adjacent the lower end of the tube 38. When the tube 38 does not contain liquid asphalt, or when the flue temperature otherwise tends to exceed the preset temperature, that flue temperature is directly sensed by the sensing element 42 and the main burner is throttled back. In this way, the temperature within the kettle is less likely to exceed the preset temperature.

It should be understood that the foregoing relates only to a preferred embodiment, and that numerous changes or modifications may be made therein without departing from the spirit and scope of the invention as defined in the following claims.

I claim:

1. High velocity gas fuel burner apparatus with improved pilot light, comprising:

main burner means having an outlet port operative to direct a flow of gas fuel toward a burner passage at substantial velocity in a predetermined direction for ignition within said burner passage; and a pilot gas burner providing a pilot flame originating behind said main burner outlet port and directed forwardly toward said main burner outlet port so that the pilot flame ignites the gas fuel entering said burner passage, the origin of the pilot flame at said pilot gas burner being located behind the point of ignition of the main burner and thereby not inadvertently extinguished by the ignition blast of the main burner flame.

2. Apparatus as in claim 1, wherein:

said pilot burner means is operative to direct said pilot flame toward said main burner port along a path at an acute angle to said direction of the main burner flame.

3. Apparatus as in claim 1, wherein:

said main burner means comprises a secondary port located downstream from said main burner outlet port and communicating with the gas fuel being directed to said main burner outlet port; and said pilot burner directs said pilot flame toward said secondary port from said origin behind the main burner outlet port, so that the pilot flame ignites the gas fuel from the main burner downstream from said main burner outlet port while said pilot flame originates behind the main burner outlet port.

4. Apparatus of in claim 3, wherein:

said pilot gas burner is disposed in spaced apart relation to said main burner means and directs said pilot flame across free space toward said secondary port.

5. Apparatus as in claim 1, further comprising igniter means selectably operative to ignite said pilot flame.

* * * * *